United States Patent [19]

Fonseca et al.

[11] 4,253,703

[45] Mar. 3, 1981

[54] METHOD FOR MINING COAL USING AMMONIA AND NITRIFYING BACTERIA

[75] Inventors: Anthony G. Fonseca; Bruce G. Bray; Randolph M. Kosky, all of Ponca City, Okla.

[73] Assignee: Conoco, Inc., Ponca City, Okla.

[21] Appl. No.: 100,601

[22] Filed: Dec. 5, 1979

[51] Int. Cl.[3] ..... E21C 41/04

[52] U.S. Cl. ..... 299/5; 166/246; 241/1; 435/248

[58] Field of Search ..... 299/5, 4; 435/822, 37, 435/166, 170, 248; 241/2, 81; 166/246; 71/24, 7, 8, 9; 44/1 B

[56] References Cited

U.S. PATENT DOCUMENTS

| | | | |
|---|---|---|---|
| 3,918,761 | 11/1975 | Aldrich | 299/5 |
| 4,108,722 | 8/1978 | Stover | 299/4 X |

*Primary Examiner*—Ernest R. Purser

*Attorney, Agent, or Firm*—Cortlan R. Schupbach, Jr.

[57] ABSTRACT

Subterranean coal seams are treated with ammonia to enhance methane removal and improve the mineability of coal. Residual ammonia remaining from the coal treatment is removed by contacting the coal seam with nitrifying bacteria after ammonia treatment and before mining is carried out.

7 Claims, No Drawings

METHOD FOR MINING COAL USING AMMONIA AND NITRIFYING BACTERIA

This invention relates to a method for mining coal using chemical agents. More particularly, this invention relates to a process of treating a coal seam with ammonia to enhance mineability of the coal, then treating the ammonified coal seam with a nitrifying bacteria to remove detrimental ammonia prior to mining.

Coal is mined using any of several methods such as strip mining in which coal is merely dug out of the ground by mechanical or hydraulic means and transferred to the place of use, or underground mining using methods such as slurry mining, room and pillar mining or long-wall mining. The means for taking coal from the ground in the room and pillar or long-wall methods are generally mechanical cutters, rippers, plainers, loaders, and so forth. In slurry mining, hydraulic apparatus is used to direct pressurized water at the coal seam to disaggregate the coal and form a slurry which is then pumped out of the mine to the surface. However, all of these coal mining techniques first require loosening the coal from the formation. Coal loosening is usually carried out by using explosive hydraulic pressures or physically contacting the coal with cutters or mining machines before the coal is transported away from the mine to the place of use. These methods require much time and large capital outlays for expensive loosening equipment. This equipment forces coal into pieces of convenient size which can then be further broken down by mechanical procedures such as crushing, milling, grinding, pulverizing and so forth. The degree of reduction and size is of course suited to the application for which the coal is to be used or to satisfy transportation requirements.

Attempts have been made in the coal industry to find an agent which would attack the coal in such a way that the bonds between the coal constituents would be weakened and mechanical separation of the coal is enhanced. Methods have been disclosed wherein addition of inorganic or organic salts in weak aqueous solutions have suppressed the formation of fragments in the airborne size range during conventional coal cutting, although no particular advantage is cited in the size reduction process.

U.S. Pat. No. 1,532,826 to Lessing teaches treating coal with an acid or aryl amine to facilitate mechanical segregation of the coal. This treatment, while facilitating mechanical separation, did not result in complete disaggregation of the coal as does acid treatment in phosphate mining as described in U.S. Pat. No. 3,359,037.

Attempts have been made in the past to treat coal by various methods in order to recover liquid or gaseous fuels therefrom, either insitu or after coal has been removed from the mine. It is preferred to carry out such treatments insitu because of costs involved. However, such attempts have normally not been successful because the coal seam is generally impermeable to recovery fluids injected into coal formations and cannot be sufficiently contacted by the fluid to obtain adequate recovery.

In addition, the danger of explosion from methane gas contained in coal seams has created a hazard. Methane has been extremely difficult to remove from shafts as coal seams are followed underground. As mining continues, concentration of methane gas within mines has caused explosions which result in loss of life, Usually, mining in the vicinity of the explosion is not possible. Under present procedures, several control techniques are considered useful for the elimination of methane from mines. Such methods include controlled dilution with air or ventilation of the mine, blocking or diverting the gas flow in the coal bed by using sealing means, and the removal of pure or diluted methane through the use of boreholes.

A particular problem with ventilation of the mine concerns dust supression which is a problem of great concern because the dust in many cases is explosive and causes respiratory problems to miners. Where methane is a serious problem, ventilation must be carried out using large air volumes, creating dust hazards because more dust is forced into suspension due to air velocity.

The art has developed many means for facilitating removal of coal and supression of dust and removal of methane in mines. Among these is U.S. Pat. No. 3,918,761 which deals with the chemical comminution of coal by treatment with ammonia. U.S. Pat. No. 4,032,193 describes treating coal with sodium hydroxide or ammonium hydroxide to disintegrate the coal, followed by slurry mining of the disintegrated coal. British Pat. No. 1,080,853 describes a process for fracturing coal utilizing low boiling liquids (including ammonia) as a fracturing fluid in a degasification process. U.S. Pat. No. 1,532,826 describes a process of treating a coal seam face with acid or base to enhance mining. U.S. Pat. No. 3,850,477 describes a process of treating a coal seam with anhydrous ammonia to disintegrate the coal, followed by recovering the disintegrated coal particles in a gas suspension and moving them to the surface as a suspension. These references also teach method of applying ammonia including drilling boreholes, using pressure and suction apparatus and so forth. These methods or combinations of these methods can be used in the practice of the instant invention.

As beneficial as all these prior art references have been to the art as a whole, none of them have dealt with the combined problems of the state of the coal after treatment with ammonia. In addition, removal of methane remains a severe problem. It would therefore be of great benefit to provide a method for chemically comminuting coal using ammonia followed by a satisfactory treatment to remove ammonia from the mine and coal seam while decreasing the amount of methane present.

It is therefore an object of the instant invention to increase methane release and to degrade the mechanical strength of coal seams to prevent easier, safer, and more rapid coal mining while reducing residual ammonia vapors and their consequential effect on miners. Other objects will become apparent to those skilled in this art as the description proceeds.

We have now discovered according to the instant invention that coal mining is made much easier and safer by the treatment of coal seams with ammonia or ammonium hydroxide to chemically comminute the coal and increase the flow of methane through the formation, then after a sufficient length of time, contacting the coal seam containing ammonia with a nitrifying bacteria to convert the ammonia present to a water soluble nitrate. Treatment with the bacteria is made sufficiently early to allow bacterial action to remove ammonia prior to actual mining of the coal.

Thus the instant invention comprises a method for removing subterranean coal by contacting said coal in-situ with an effective amount of moist ammonia or aqueous ammonium hydroxide to chemically comminute the coal, then placing nitrifying (autotrophic) bacteria in contact with the ammonia-impregnated coal, and mining said coal when bacterial action has reduced ammonia content of the coal to a desired level.

The bacteria useful in the practice of the instant invention are generally those which cause conversion of ammonia or ammonium to nitrate species. Representative but non-exhaustive examples of such bacteria are those of the genera, Nitrosomonas and Nitrobacter.

Mixtures of such bacteria are effective in the practice of the present invention so long as such bacteria are not inimical to one another.

Normally the bacteria are inserted into the coal seam in a water solution, although this is not necessary. It is simply more convenient and more effective to place such bacteria in water and pass them into and through fractures formed in the coal seam by ammonia treatment. In order for these bacteria to convert the $NH_3$molecule to an aqueous water soluble molecule such as $NO_2^-$ or $NO_3^-$, it is necessary that air or oxygen be provided for the conversion. Therefore it is preferred to pass ambient atmosphere (air) together with the bacteria solution through the coal seam, although a more expensive oxygen enriched atmosphere is to be desired. An oxygen-enriched atmosphere would increase the rate of ammonia removal.

Once the bacteria are in place, it is necessary to allow them to remain so for a period of time sufficient to reduce the ammonia content of the seam to desired levels prior to beginning mining. Normally, when an effective amount of ammonia is used to fracture or chemically comminute a coal seam, such bacteria will necessarily remain in place for a period of time ranging from about 2 weeks to about 2 years. Normally, such bacteria will remain in place from about 1 to about 6 months and a period of about 3 months will be the most preferred time. Of course the time the bacteria remain in place is necessarily dependent upon the conditions for the conversion of the ammonia present. With optimum bacteria input and adequate oxygen flow for conversion, the bacteria can reduce even high ammonia concentrations in a matter of weeks.

Once the coal has been chemically comminuted and the ammonia concentration has been reduced, removal of the coal can be by any one of several means including mining, hydraulic mining, blasting, mining machines, and so forth. However, for some applications it would be preferred to use hydraulic mining, wherein the water used to mine the coal has a pH of from about 5.0 to about 6.9 in order to further neutralize any remaining traces of ammonia in the coal seam.

Application of ammonia to a coal seam produces increased permeability for increased methane drainage from the coal seam, thus reducing the danger of explosion due to methane accumulation. The ammonia treatment likewise decreases the mechanical shear strength of the coal, resulting in easier mining conditions by conventional continuous or longwall methods, including the modern slurry coal methods. These are known to the prior art. However, the present invention removes objectionable ammonia vapors and odors from the coal seam and permits mining personnel direct access to the coal seam.

The invention is more concretely described with reference to the examples below wherein all parts and percentages are by weight unless otherwise specified. The examples are provided to illustrate the instant invention and not to limit it.

EXAMPLE 1

The flow rate of gaseous ammonia through confined coal samples was only one-half that of the initial gaseous flow rate through these coal samples. This indicates that the ammonia causes the coal to "swell" . This "swelling" initially reduces the permeability of the coal and also produces stresses within individual coal particles. Experimental observation showed that cracks are formed throughout the coal sample as a means of relieving the stress caused by ammonia adsorption in the coal. After the coal seam has been treated with gaseous ammonia, some of the ammonia was recovered by the use of a vacuum system or the suction side of a methane recovery compressor.

EXAMPLE 2

After treating the coal with gaseous ammonia, the flow rate of methane increased two-fold. Increased flow rate was the result of cracks formed in relieving the built-up stresses caused by the ammonia treatment and subsequent ammonia removal. The increased crack matrix in the coal samples allowed more ready desorption of methane which was adsorbed onto the coal. The coal so treated was tested for mechanical strength and shown to be highly degraded as compared to the original samples.

In these tests, Pittsburgh #8 seam coal was pressurized with $NH_3$at a pressure of 95 pounds per square inch gauge (psig) for 70 hours. Four large pieces of coal (1860 g, 1407 g, 1344 g and 812 g) were used. At the conclusion of the test, the size distribution was as follows:

| | |
|---|---|
| + 1" | 1.3 weight % |
| 1 × ¾ | 1.6 weight % |
| ¾ × ½ | 5.1 weight % |
| ½ × ⅜ | 8.8 weight % |
| ⅜ × ¼ | 17.3 weight % |
| ¼ × 8 Mesh (m) | 37.1 weight % |
| 8m × 28m | 25.1 weight % |
| 28m × 48m | 3.4 weight % |
| 48m × 60m | .02 weight % |
| −60m | .14 weight % |

A second test was carried out on +⅜" Pittsburgh #8 Seam Coal. A pressure of 100 psig $NH_3$ was used for 2 hours. The resultant coal size was as follows:

| | |
|---|---|
| + ⅜" | 60.9 weight % |
| ⅜" × 4 Mesh | 7.4 weight % |
| 4m × 14m | 18.0 weight % |
| 14m × 28m | 6.6 weight % |
| − 28m | 7.0 weight |

EXAMPLE 3

The uncomfortable and dangerous mining condition caused by ammonia present in coal seams was reduced by first using a vacuum on the coal example as set forth in Example 1. Then a slightly acidic solution of mine water was injected to neutralize the remaining ammonia. However, experiments showed that the use of such water resulted in some precipitates in the flow channels which reduced permeability. Ammonia in the seam at a distance from the mine face would not be effectively neutralized because of the blockage caused by the precipitates.

EXAMPLE 4

As an alternate method of ammonia neutralization, nitrifying bacteria (Nitrosomonas) can cause conversion of ammonia used in the in-situ leaching from coal seams. Use of such bacteria indicates that a reduction in ammonia could be obtained when such bacteria are present together with sufficient oxygen.

Nitrifying bacteria (autotrophic bacteria) such as Nitrosomonas and Nitrobacter were studied in the in-situ leading of uranium and it was noted that ammonium present would disappear. Such studies are set forth in the Center for Water Resources Report—155, 1978, Austin, Tex.

Any residual ammonia fumes would be lessened using a mining system such as that described in U.S. Pat. No. 3,874,733 describing a hydraulic method of mining and conveying coal, and U.S. Pat. No. 3,993,146, an apparatus for mining coal using vertical bore hole and fluid. These patents require high pressure water jets to break the coal away from the mine face. The broken coal is then slurried and pumped to the surface. The ammonia treatment reduces the sheer strength of the coal allowing lower pressure jets or washing to achieve a similar result. The use of acidified water in such processes, even through acidified at very low levels, would neutralize any remaining ammonia. Plugging of pore channels would be of no concern since the pore channels directly affected by iron precipitation would be substantially instantaneously broken away from the mining face, exposing fresh fractures.

Thus the advantages of the present invention are clear; chemical comminution of coal, removal of methane, and a simple method for removing the residual ammonia to provide enhanced coal recovery.

While certain embodiments and details have been shown for the purpose of illustrating this invention, it will be apparent to those skilled in this art that various changes and modifications may be made herein without departing from the spirit or scope of the invention.

We claim:

1. A method for removing subterranean coal comprising (a) contacting said coal in-situ with an effective amount of moist ammonia or aqueous ammonium hydroxide to chemically comminute the coal to the extent desired, then (b) placing nitrifying (autotrophic) bacteria in contact with the ammonia impregnated coal, and (c) mining said coal when bacterial action has reduced ammonia content of the coal to a desired level.

2. A method as described in claim 1 wherein the bacteria used is selected from the group consisting of Nitrosomonas or Nitrobacter bacteria, and mixtures of these.

3. A method as described in claim 2 wherein the bacteria are placed in the coal using a bacteria-containing aqueous solution.

4. A method as described in claim 3 wherein the mining is delayed for a period of time ranging from about 2 weeks to about 2 years after bacterial content.

5. A method as described in claim 4 wherein oxygen, air, or water containing oxygen is forced through the coal after bacterial contact to hasten ammonia conversion and removal.

6. A method as described in claim 5 wherein hydraulic mining is used to remove coal after chemical comminution.

7. A method as described in claim 6 wherein water with a pH of from about 5 to about 6.9 is used to remove coal and neutralize residual ammonia.

* * * * *